US005865358A

United States Patent [19]

Fernandez

[11] Patent Number: 5,865,358

[45] Date of Patent: Feb. 2, 1999

[54] BREAKER MACHINE

[75] Inventor: Jose MaVillacieros Fernandez, Vigo, Spain

[73] Assignee: Ward Holding Company, Wilmington, Del.

[21] Appl. No.: 848,982

[22] Filed: May 2, 1997

[51] Int. Cl.[6] ..... B26F 3/02

[52] U.S. Cl. ..... 225/101; 225/97

[58] Field of Search ..... 225/2, 4, 930, 225/97, 100, 101

[56] References Cited

U.S. PATENT DOCUMENTS

| | | | |
|---|---|---|---|
| 2,171,769 | 9/1939 | Stolar et al. . | |
| 2,268,190 | 12/1941 | Copeland et al. . | |
| 3,780,921 | 12/1973 | Harp | 225/2 |
| 3,794,228 | 2/1974 | Colwill et al. | 225/93 |
| 4,025,023 | 5/1977 | Moffitt | 225/100 |
| 4,171,081 | 10/1979 | Vossen et al. | 225/97 |

FOREIGN PATENT DOCUMENTS

4113792A1 10/1992 Germany .

*Primary Examiner*—Rinaldi I. Rada
*Assistant Examiner*—Kevin G. Vereene
*Attorney, Agent, or Firm*—Bartlett & Sherer

[57] ABSTRACT

A machine for breaking portions of bundles of sheets of material is disclosed in which first and second sets of clamps secure first and second portions of a bundle on opposite sides of a break line and, while the first bundle portion is retained in a stationary position by the first set of clamps, the second set of clamps is moved in first and second arcuate motions about first and second pivot points.

13 Claims, 5 Drawing Sheets

BREAKER MACHINE

FIELD OF THE INVENTION

This invention relates to a machine for separating, or "breaking," bundles of sheets of material into multiple stacks, and more particularly, to a breaker machine for separating connected portions of bundles of articulated sheets into separate stacks of product portions.

BACKGROUND

In the art of printing and die cutting sheets of material, such as corrugated paperboard for manufacturing containers, for example, it is known that die cutters may cut and slot each sheet of material so as to form a multiplicity of product portions on each sheet. By way of a simplified example, the die cutter may cut each sheet of material such that three or more cartons, or carton tops, or other product portions may be produced from each sheet of paperboard, plastic or other sheet material. This practice allows substantial economics of manufacture by efficiently utilizing the maximum square foot area of each sheet of material and minimizing the amount of waste portions of each sheet. Such sheets of material, having multiple product portions connected together by small connecting portions, are hereafter sometimes referred to as "articulated" sheets as will be more fully explained.

After the articulated sheets have been die cut, which usually follows the printing of indicia on each sheet, pluralities of sheets are stacked in relatively short bundles, and the bundles are sent to a breaker machine in order to separate the bundles into separate stacks of product portions. This breaking of bundles into separate product portions has been a long-standing problem for many reasons. For example, the ultra-high speed printing and die cutting machines of the present day, which can process 1,000 board feet per minute of sheets, require that the breaking function keep pace with the total production line. This requires that the number of sheets per bundle, and therefore, per "break," be increased over that previously possible, and the number of breaks per unit of time must be increased. Secondly, the break must be "clean" with no tears in the product portions. Furthermore, some connecting portions must not be broken along straight lines, but rather, along right angles and rounded connecting portions between product portions such as in the cases of "nested" or "lock bottom" sheets, respectively.

SUMMARY

All of the above-indicated long-standing problems are solved by the present invention by a unique manner of accomplishing the "break." That is, the present invention does not bend the adjacent portions of the bundle to break it, nor does it pull the bundle portions apart laterally as in the prior art breakers. Instead, the present invention clamps one portion of the bundle in upper and lower clamps, and maintains the first clamped portion in a stationary position. The second portion of the bundle is clamped by upper and lower clamps, and the second portion is separated in two successive steps. That is, one edge of the second bundle portion is forced away from the first bundle portion which tears the bundle partially across its width. Then, while the bundle portions are held separated along the first edge, the opposite edge of the second bundle portion is forced away from the first bundle portion so as to complete a very rapid and clean break between the bundle portions. These and many other objects and advantages of the present invention will become apparent from the following description of one preferred embodiment as illustrated in principle in the following drawings.

DETAILED DESCRIPTION

Figure 1:
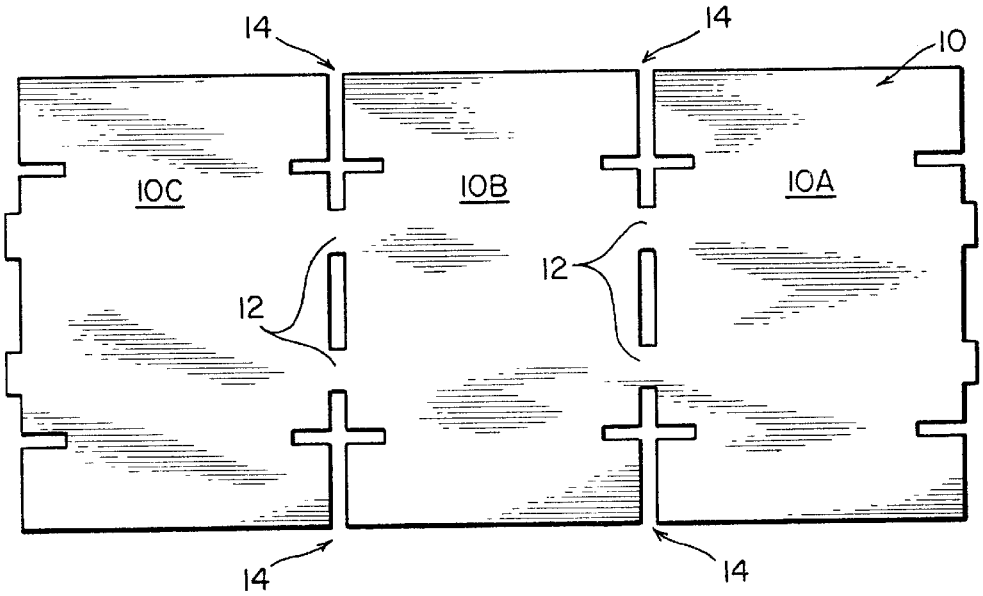
FIG. 1 is a top plan view of one sample of articulated sheet.

FIG. 1 schematically illustrates one articulated sheet 10 which, for example, may be one sheet of corrugated paperboard which has been die cut to form three connected tops 10A, 10B and 10C for containers. Of course, it will be understood that sheet 10 is purely an example, and is simplified for purposes of clarity. Tops 10A, 10B and 10C are connected to each other by relatively small connecting portions 12 remaining in cutout slots 14 such that, when portions 12 are severed, sheet 10 is intended to produce three separate container tops 10A, 10B and 10C. Such articulated sheets are typically stacked together to form bundles, and the bundles are then sent to the breaker to separate them into three stacks of product portions 10A, 10B and 10C.

Figure 2:
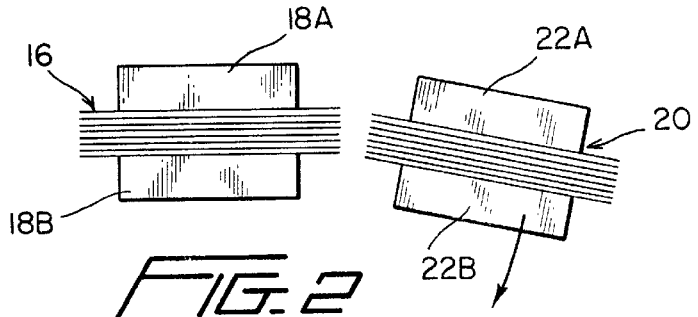
FIG. 2 (PRIOR ART)
FIG. 2 is a schematic side view of one form of prior art breaker.

FIG. 2 schematically illustrates one prior art method of breaking adjacent product portions of stacked articulated sheets. In this method, one portion 16 of the bundle is clamped by upper and lower clamps 18A–B, and the adjacent portion 20 of the bundle is clamped by upper and lower clamps 22A–B. Clamps 22A–B are then deflected downwardly as shown in order to perform the break between adjacent stacks of product portions. However, in order to separate the bottom-most layers of sheets, the top portions must be separated by a wider dimension such that more power is required.

Figure 3:
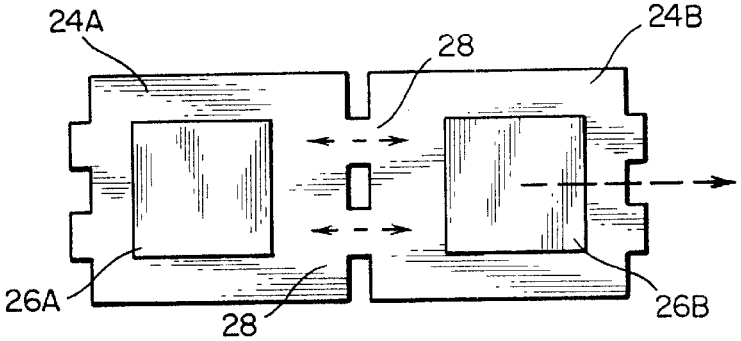
FIG. 3 (PRIOR ART)
FIG. 3 is a schematic top view of another form of prior art breaker.

In FIG. 3, the upper surfaces of product portions 24A–B are shown as clamped by upper clamps 26A–B, and it will be understood that lower clamps (not shown) are provided so as to clamp product portions 24A–B therebetween. In order to separate product portions 24B from product portions 24A, upper and lower clamps 26B are forced linearly apart from upper and lower clamps 26A such that the connecting portions 28 are pulled apart under purely tensile force. This tends to pull the fibers of the sheets and does not result in a clean severing. In addition, much greater force is required to pull the portions apart by tensile force alone since no tearing or severing force is present. In summary, the prior art breakers require excessive power requirements and often do not provide clean breaks, particularly for thick bundles or bundles having large widths and many connecting portions.

The mode of operation of the breaker of the present invention is illustrated in schematic FIGS. 4A–4D wherein the top articulated sheet 10 of a bundle 30 is illustrated in top plan view as in FIG. 1. As will be further described hereinafter, bundle 30 has been moved in the direction of arrow A into the illustrated position in the breaker by a plurality of conveyor belts 32. Once in the illustrated position, the stack of product portions 30A is located below clamping member 40A and the stack of product portions 30B is located below clamping member 40B. Preferably, each of clamping members 40A and 40B include a plurality of pads 42 which may be composed of metal, or preferably of a slightly resilient material such as hard rubber or plastic so as to prevent scuffing or denting of the upper and lowermost layers of the bundle. Of course, as will be more fully described hereinafter, a second pair of clamping members 44A and 44B are located directly below clamping members 40A and 40B, respectively. Thus, the two stacks of product portions 30A and B are clamped therebetween when the upper and lower clamping members are moved vertically into firm clamping engagement with the uppermost and lowermost sheets of material comprising the bundle.

Figure 4A:
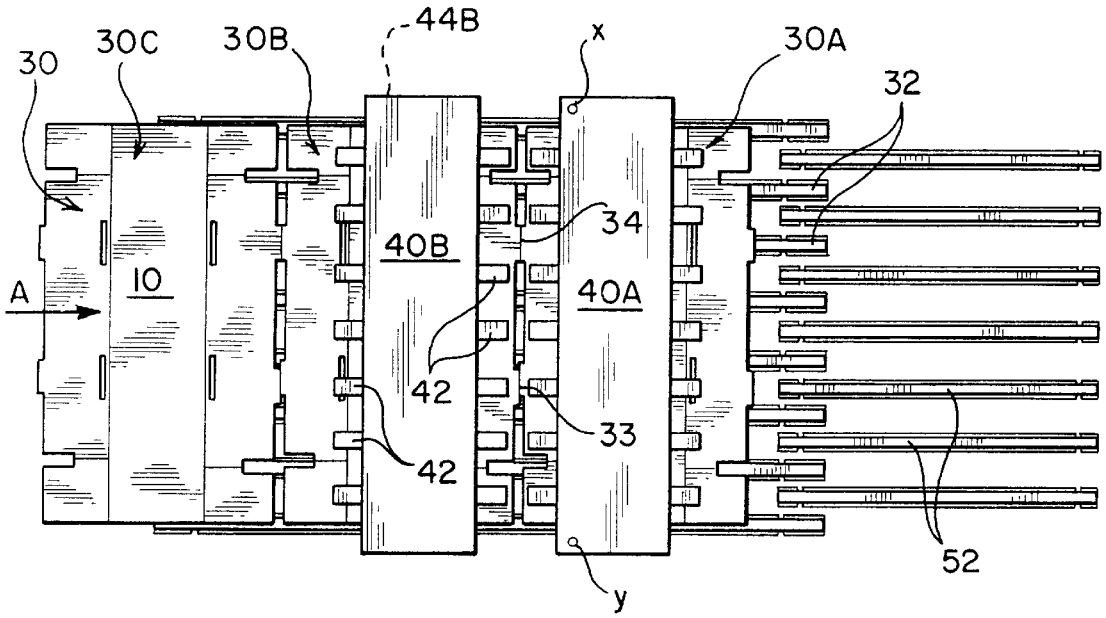
FIGS. 4A–4D are schematic top views of the sequence of positions of the breaker of the present invention.

The unique severing motion of the present invention comprises the following steps as illustrated in FIGS. 4A–4D. In FIG. 4A, bundle 30 has been securely clamped as just described, and it is to be understood that upper clamping member 40B and associated lower clamping member 44B remain in the same stationary position throughout the sequence of FIGS. 4A–4D. However, upper clamping member 40A, and associated lower clamping member 44A, are each mounted with two movable pivot points X and Y. Accordingly, pivot points X and Y are sometimes referred to hereafter as "floating" pivot points.

Figure 4B:
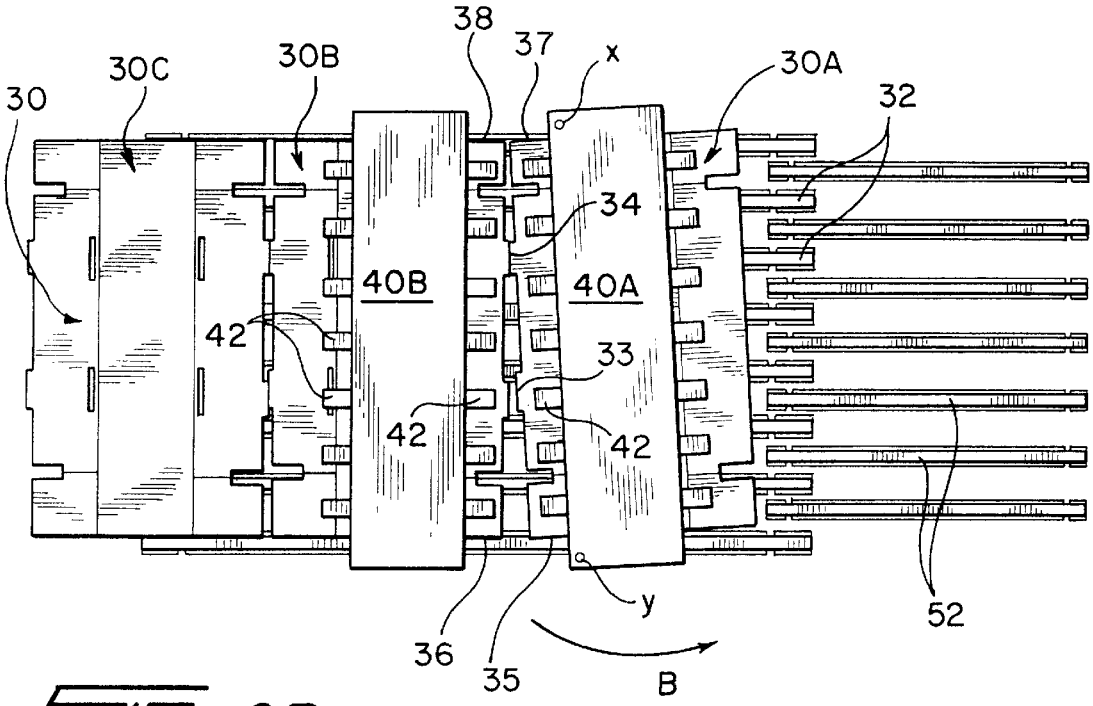

As shown in FIG. 4B, pivot point X has remained stationary while pivot point Y has moved to the right in an arcuate path illustrated by arrow B. This arcuate motion of clamping members 40A and 44A about stationary pivot point X instantly and cleanly tears connecting portion 33 apart as edge 35 of stack 30A is forced away from edge 36 of stack 30B. It will also be noted that the severing action is a progressive action on connecting portions 33 which begins at the point of the connecting portions which is closest to the edges 35, 36 of the stack, and this severing force then progresses toward the opposite edge of the stack as the kerf progressively widens across the connecting portions 33 of the bundle. This mode of progressive severing substantially reduces the amount of force, and therefore power, which is required for breaking a stack of a given thickness. In addition, it produces cleaner breaks, and is extremely rapid.

Figure 4C:
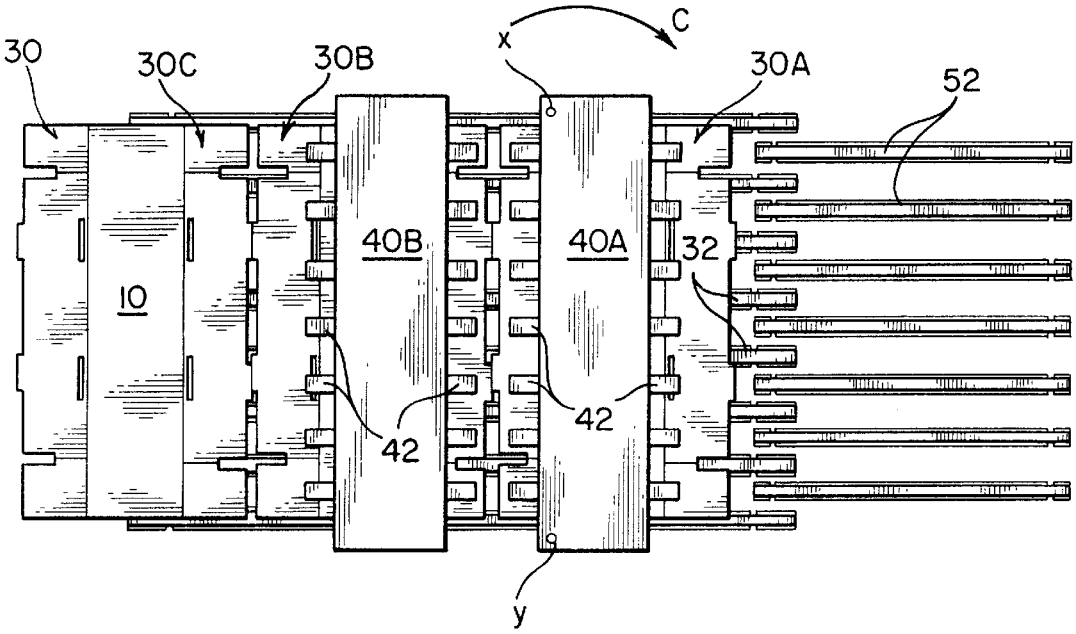

After the first severing action as just described, pivot point Y becomes fixed in the position shown in FIG. 4B. Then, as shown in FIG. 4C, pivot point X is moved in an arcuate path shown by arrow C about pivot point Y. This produces a second, progressive severing action in the reverse direction; ie, from edges 37, 38 across the width of the stack toward the center of the stack. This instantly tears connecting portions 34 such that stack 30A is fully severed from stacks 30B and C. Of course, it will be understood that in the simplified illustrations, only two sets of connecting or severing portions 33 and 34 are shown whereas, in commercial practice, the stacks in a given bundle may be connected by many connecting portions along the width of the bundle. Thus, by providing a progressive severing action across the width of the bundle as described, many connecting portions may be severed in the first arcuate movement illustrated in FIG. 4B followed by severing the remaining connection portions in the second arcuate movement and progressive severing action illustrated in FIG. 4C. For example, in the preferred embodiment of the invention, the first arcuate movement about pivot point X severs more than half of the connecting portions, such as 51% to 75% of the connecting portions, and the second arcuate movement about pivot point Y severs the remaining connecting portions.

Having described the unique severing motions of the present breaker in primarily functional terms, one illustrative example of one form of structure for accomplishing this unique function will now be described with reference to FIGS. 5 and 6. The breaker of the present invention is preferably positioned between a feed conveyor 50 and a take-off conveyor 52. In between these two conveyors are positioned the plurality of side-by-side breaker conveyors 32 referred to previously. On either side of breaker conveyors 32 are provided a pair of vertically extending walls or other rigid and vertically extending support members 54. An upper support block 56 and a lower support block 58 of the breaker machine may be rigidly connected to supports 54. Upper support block 56 mounts a power cylinder 60 having an actuating rod 62, and lower support block 58 carries a power cylinder 64 having an actuating rod 66. Upper rod 62 is rigidly connected to an upper carriage 68, and lower rod 66 is rigidly connected to a lower carriage 70. Upper carriage 68 carries clamping member 40B including pads 42, and lower carriage 70 carries clamping member 44B and its pads 42 as previously described. Upper and lower clamping members 40B, 44B are rigidly connected to carriages 68, 70 and do not pivot as shown in FIGS. 4A–C.

Upper carriage 68 also carries clamping member 40A, such as in a horizontal slot 90, and lower carriage 70 carries clamping member 44A, such as in a similar horizontal slot 92. Engagement pads 42 may be connected to clamping members 40A and 44A by vertical rods or pins 94 which extend through vertical bores or slots 96 in the carriages. Of course, many other mounting arrangements are possible so long as clamping members 40A, 44A may be raised and lowered by the carriages while also permitting the first and second pivoted movements of the clamping members as previously described.

Figure 5:
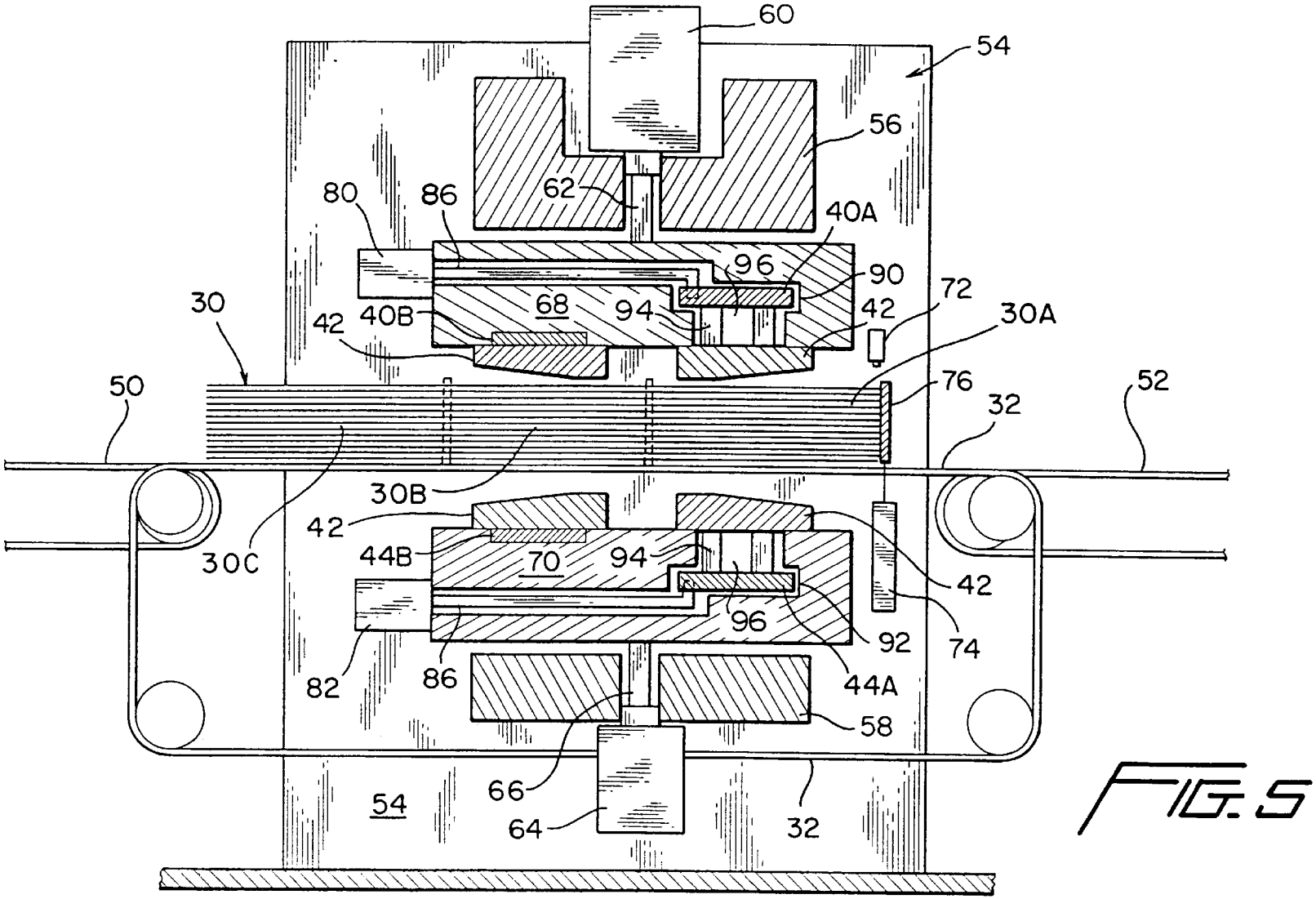
FIG. 5 is a schematic side elevational view partly in cross-section.
Figure 6:
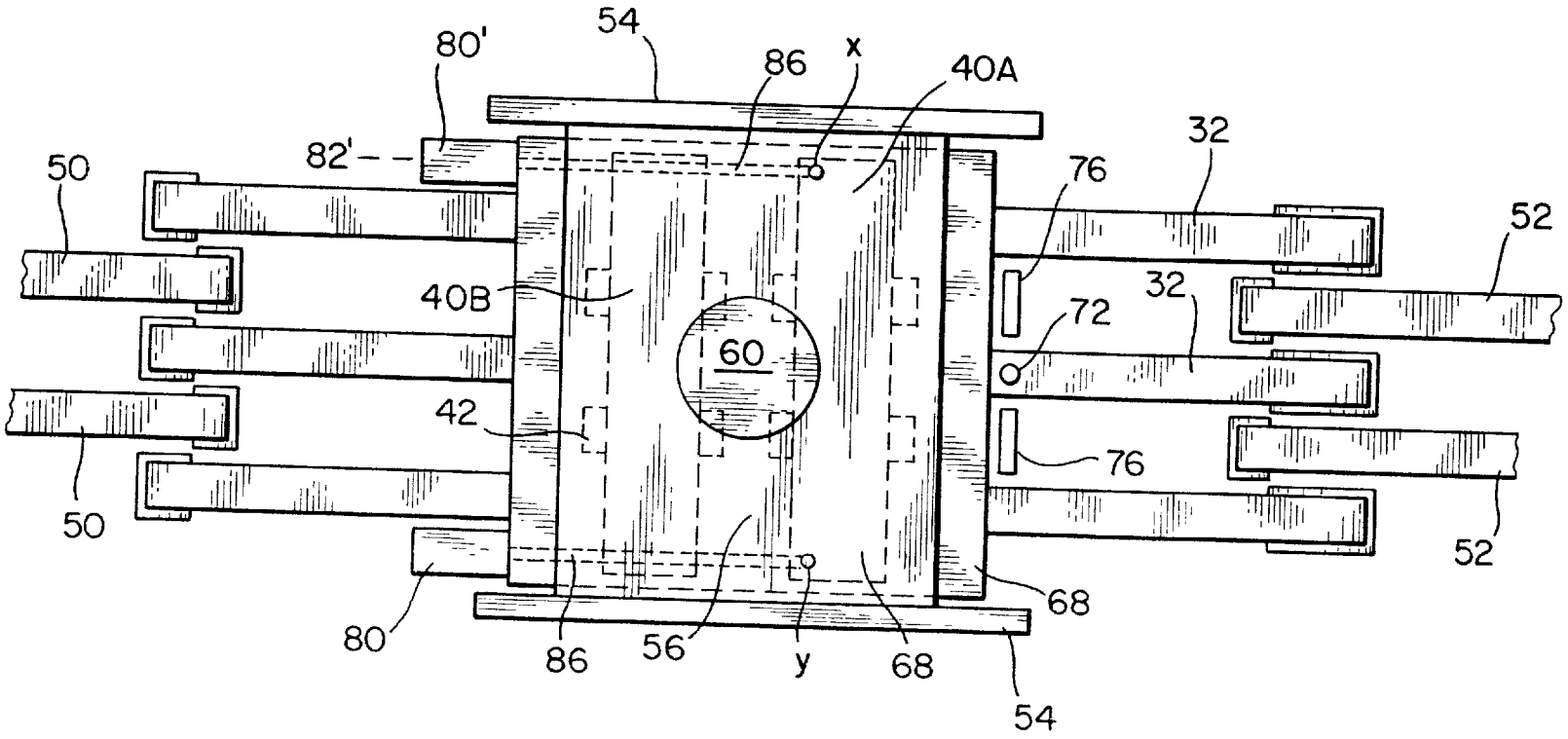
FIG. 6 is a top plan view of the breaker of FIG. 5.

The means for causing clamping members to execute the pivotal movements may also take many forms and, solely for purposes of example, FIGS. 5 and 6 illustrate four power cylinders 80, 82, 80' and 82'. Cylinders 80 and 80' are mounted on upper carriage 68 near the sides of the carriage as viewed in FIG. 6, and cylinders 82, 82' are mounted directly below cylinders 80, 80' on the lower carriage 70; cylinder 82' being hidden by cylinder 80' in FIG. 6. One of four actuating rods 86 extends horizontally from each of the power cylinders to one edge of one of clamping member 40A and 44A as shown in FIGS. 5 and 6. Many forms of pivotal connection are possible, one of which is that the ends of the rods may be bent such as to form short vertical portions received in the clamping members. These vertical portions form floating pivot points X and Y for each of upper clamping member 40A and lower clamping member 44A. Thus, individual horizontal movement of each rod 86 by its associated power cylinder enables the clamping members to execute the double-pivoted motion previously described.

The overall operation of the breaker of the present invention is as follows. Referring first to FIG. 5, when a bundle 30 has been conveyed into the breaker, the presence of its leading edge is detected by sensor means such as, for example, a proximity sensor 72. Sensor 72 actuates one or more power cylinders or solenoids 74 to raise one or more stop members 76 upwardly between side-by-side conveyors 32. Accordingly, raised stop members 76 stop bundle 30 in the exact position shown in FIG. 5 wherein connecting portions 33 and 34 are midway between clamping members 40A and 40B. Power cylinder 64 is then actuated to raise lower carriage 70 and pads 42 above the board line of conveyors 32 so as to elevate the bundle above conveyors 32. Preferably, conveyors 32 are stopped at this point. Alternately, they may continue to run since the bundle is raised above, and out of contact with, the conveyors at this point. With bundle 30 elevated out of contact with conveyors 32, power cylinder 60 is energized so that upper carriage 68 moves downwardly and its pads 42 engage and clamp the bundle securely. The bundle is then positioned and clamped for breaking in two progressive tearing movements as follows. In the first movement, upper power cylinder 80 and lower power cylinder 82 are actuated simultaneously. These cylinders simultaneously extend their associated rods 86 so as to move pivot points Y of members 40A, 44A in the arcuate motion shown by arrow B in FIG. 4B. At this time, power cylinders 80' and 82' are not actuated such that the vertical ends of their associated rods are fixed and function as fixed pivot points X. Thereafter, as may be determined by a timer or position sensing means (not shown) power cylinders 80' and 82' are actuated and rods 86 move upper and lower clamping members 40A and 44A in the actuate, progressively severing motion illustrated by arrow C in FIG. 4C. Of course, power cylinders 80 and 82 remain in their actuated position so as to hold pivot points Y in fixed position while pivot points X are moved in the arcuate path of arrow C and progressively sever connecting portions 34 from edges 37, 38 toward the center of the bundle as previously described with reference to FIG. 4C. Accordingly, stack 30A of the bundle is quickly and cleanly severed from stack 30B in two, arcuate and progressively severing motions which result in clean breaks with a minimum amount of energy.

Figure 4D:
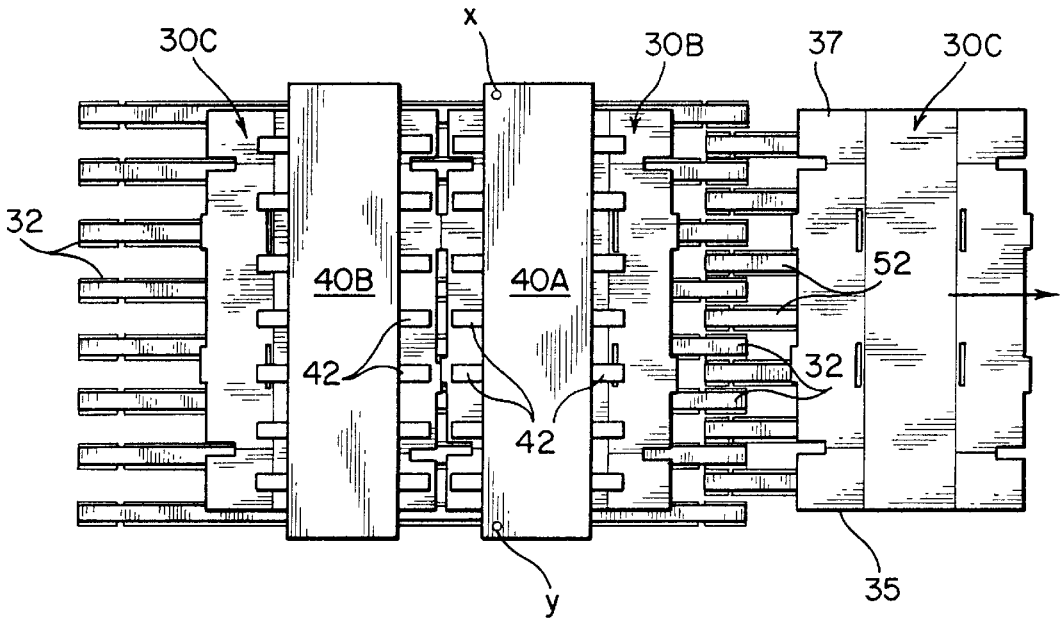

When first stack 30A has been broken, stop members 76 are dropped, and conveyors 32 move the bundle into the next position with stack 30B under member 40A and the steps are repeated while severed stack 30A is conveyed away from the breaking area as shown in FIG. 4D.

From the foregoing description of one illustrative embodiment of the invention, it will be apparent that many modifications and alternative components will become obvious to those skilled in the art. For example, while it is preferred that the power cylinders be pneumatic, they may be hydraulic or electromagnetic. Also, if the thicknesses of the bundles to be processed are relatively constant, upper carriage 68 may be made fixed, and cylinder 60 may be eliminated, such that only lower carriage 70 is vertically moveable to raise and clamp the bundle between the clamping members. Other modifications are apparent, such as mounting cylinder 80, 82, 80' and 82' on the opposite sides of clamping members 40A and 44B whereby rods 86 would be substantially shortened or eliminated. Alternatively, cylinders 80, 82, 80' and 82' may be mounted vertically; ie, such that their operating rods move vertically, and a right angle drive providing a force multiplying effect may be used to convert the vertical motion to the horizontal motion as described. In summary, the foregoing description is intended to be illustrative of the principles of the invention, and not exhaustive thereof, and the invention is not intended to be limited other than as set forth in the following claims interpreted under the doctrine of equivalents.

What is claimed is:

1. A breaker machine for breaking bundles of sheets along a predetermined break line comprising:

(a) a first set of clamping means for clamping a first portion of said bundle on one side of said break line;

(b) a second set of clamping means for clamping a second portion of said bundle on the other side of said break line;

(c) means for holding said second set of clamping means stationary;

(d) actuating means for pivoting said first set of clamping means successively about first and second pivot points so as to progressively tear said bundle along said break line; and (e) connecting means operatively connecting the aforesaid means to each other for severing said bundle into said first and second portions.

2. The breaker machine of claim 1 including conveyor means for conveying said bundles successively into said breaker machine, and operating means for disengaging each successive bundle from said conveyor means and into engagement with said first and second clamping means.

3. The breaker machine of claim 2 wherein said operating means lift said successive bundles upwardly from said conveyor means into engagement with said first and second clamping means.

4. The breaker machine of claim 1 wherein said actuating means comprise first and second power cylinders.

5. The breaker machine of claim 1 wherein said first and second bundle portions are connected by a plurality of connecting portions, and said actuating means pivot said first set of clamping means about said first pivot point for severing some of said connecting portions and subsequently about said second pivot point for severing others of said connecting portions.

6. The breaker machine of claim 1 wherein said connecting portions comprise severing portions of reduced cross-sectional area located along said break line, said severing portions connecting said first and second bundle portions prior to breaking said bundle portions.

7. The breaker machine of claim 1 wherein said actuating means and said first and second sets of clamping means are structurally positioned such as to pivot said first and second sets of clamping means in the horizontal plane.

8. The breaker machine of claim 1 wherein each of said bundles has a width, and wherein said break line extends across said width such that each of said bundles is progressively severed from opposite sides along the width of said bundle as said first and second clamping means are pivoted successively by said actuating means about said first and second pivot points.

9. A machine for breaking bundles of sheets of corrugated material comprising:

(a) each of the sheets of said bundles having first and second portions connected to each other by a plurality of severable connecting portions;

(b) each of said sheets lying in predetermined plane;

(c) first and second clamping means for clamping said first and second sheet portions; and (d) actuating means for pivoting one of said clamping means relative to the other clamping means in said predetermined plane so as to progressively sever some of said severable connecting portions and subsequently sever other severable connecting portions.

10. The machine of claim 9 wherein said sheets have widths and said plurality of severable connecting portions extend across said widths such that each of said sheets is severed progressively across said width.

11. The machine of claim 9 wherein said predetermined plane extends horizontally.

12. The machine of claim 9 including conveyor means for conveying said bundles into said machine, and operating means for moving said bundles out of engagement with said conveyor and into engagement with said clamping means.

13. The machine of claim 12 wherein said conveyor means convey said bundles horizontally and wherein said operating means lift said bundles upwardly out of engagement with said conveyor and into engagement with said clamping means.

* * * * *